US006237515B1

(12) United States Patent
Nöltge

(10) Patent No.: US 6,237,515 B1
(45) Date of Patent: May 29, 2001

(54) BUTTONHOLE SEWING MACHINE

(75) Inventor: Thomas Nöltge, Schloss-Holte (DE)

(73) Assignee: Durkopp Adler Aktiengesellschaft (DE)

( * ) Notice: Subject to any disclaimer, the term of this patent is extended or adjusted under 35 U.S.C. 154(b) by 0 days.

(21) Appl. No.: 09/686,430

(22) Filed: Oct. 11, 2000

(30) Foreign Application Priority Data

Oct. 23, 1999 (DE) ..... 199 51 127

(51) Int. Cl.[7] ..... D05B 3/06; D05B 19/12; D05B 47/04

(52) U.S. Cl. ..... 112/68; 112/470.01; 112/254

(58) Field of Search ..... 112/65, 66, 68, 112/447, 475.25, 470.04, 70, 73, 470.02, 470.01, 254, 255

(56) References Cited

U.S. PATENT DOCUMENTS 6,044,780 * 4/2000 Kastrup et al. ..... 112/66
6,095,066 * 8/2000 Noltge et al. ..... 112/66

* cited by examiner

*Primary Examiner*—Peter Nerbun
(74) *Attorney, Agent, or Firm*—Robert F. I. Conte; Lee, Mann, Smith, McWilliams, Sweeney & Ohlson

(57) ABSTRACT

A buttonhole sewing machine for the production of buttonholes on a work-piece comprises a thread feeding mechanism on the path of a needle thread which is fed in a direction of delivery. The thread feeding mechanism comprises a pivotal thread lever which has an opening for the needle thread to be led through. Further, the thread level is drivable by a triggerable positioning motor to pivot between a zero position and several positions of thread extraction.

10 Claims, 3 Drawing Sheets

BUTTONHOLE SEWING MACHINE

BACKGROUND OF THE INVENTION

1. Field of the Invention

The invention relates to a buttonhole sewing machine for the production of buttonholes on a workpeice of fabric, comprising a needle mounted in an arm, which needle is reciprocatingly drivable in a Z direction by a driving motor, forming a series of stitches, which needle is drivable by a jogging drive for the production of a zigzag seam by a motion of the needle relative to the workpiece, and which needle is drivable to pivot about an axis by means of a pivot drive; a hook bearing, which is disposed in a base plate, and which is drivable by a pivot drive to pivot synchronously and equiangularly relative to the needle about a pivot axis which extends in the Z direction; and a thread feeding mechanism in the path of a needle thread which is fed in a direction of delivery.

2. Background Art

U.S. Pat. No. 1,372,473 teaches a buttonhole sewing machine of the generic type for the production of eye-type buttonholes, in which stitch forming takes place in customary and known manner in a zigzagging sequence of stitches with a single thread chain stitch and a double thread chain stitch alternating. Single thread chain stitching only requires a needle thread, whereas double thread chain stitching needs both the needle thread and a hook thread or under-thread. This known buttonhole sewing machine is provided with a device for the control of the needle thread, in which, on a shaft that rotates at half the speed of the arm shaft, a pair of disks, which co-rotate therewith, and a cam are disposed for the control of a thread clamp.

U.S. Pat. No. 4,590,879 teaches a thread feeding mechanism of a sewing machine, in which a cam disk is provided, which rotates at half the speed of the arm shaft and which, by two portions on its periphery that are remote from the axis of rotation and by two portions that are close to the axis of rotation, acts on the thread supplied to the needle in such a way that the thread is tensioned i.e., it is pulled or loosened i.e., released.

SUMMARY OF THE INVENTION

It is an object of the invention to embody a buttonhole sewing machine of the generic type such that by simple means varying thread feedings are attained for the alternating production of a single thread chain stitch and a double thread chain stitch.

According to the invention, this object is attained by the features wherein the thread feeding mechanism comprises a pivotal thread lever with an opening for the needle thread to be led through; and wherein the thread lever is drivable by a triggerable positioning motor to pivot between a zero position and several positions of thread delivery. The measures according to the invention help ensure that, by means of a thread lever to be triggered by a positioning motor, handling the needle thread i.e., feeding the thread or advancing the thread and tightening or withdrawing the thread, can be suited to given conditions of sewing, which helps obtain an optimum appearance of the array of stitches. Sewing conditions comprise for example the motion of the needle relative to the workpiece i.e., the factual consumption of thread. Further factors of influence are the type of workpiece, the thickness of the workpiece, the thickness of the needle thread, the conditions of friction between the workpiece and the needle thread, the work tolerances of the elements of stitch formation i.e., needle and hook. The solution according to the invention also enables the thread to be advanced for, and in combination with, thread cutting.

Details of the invention will become apparent from the ensuing description of an exemplary embodiment, taken in conjunction with the drawing.

DESCRIPTION OF THE PREFERRED EMBODIMENT

Figure 1:
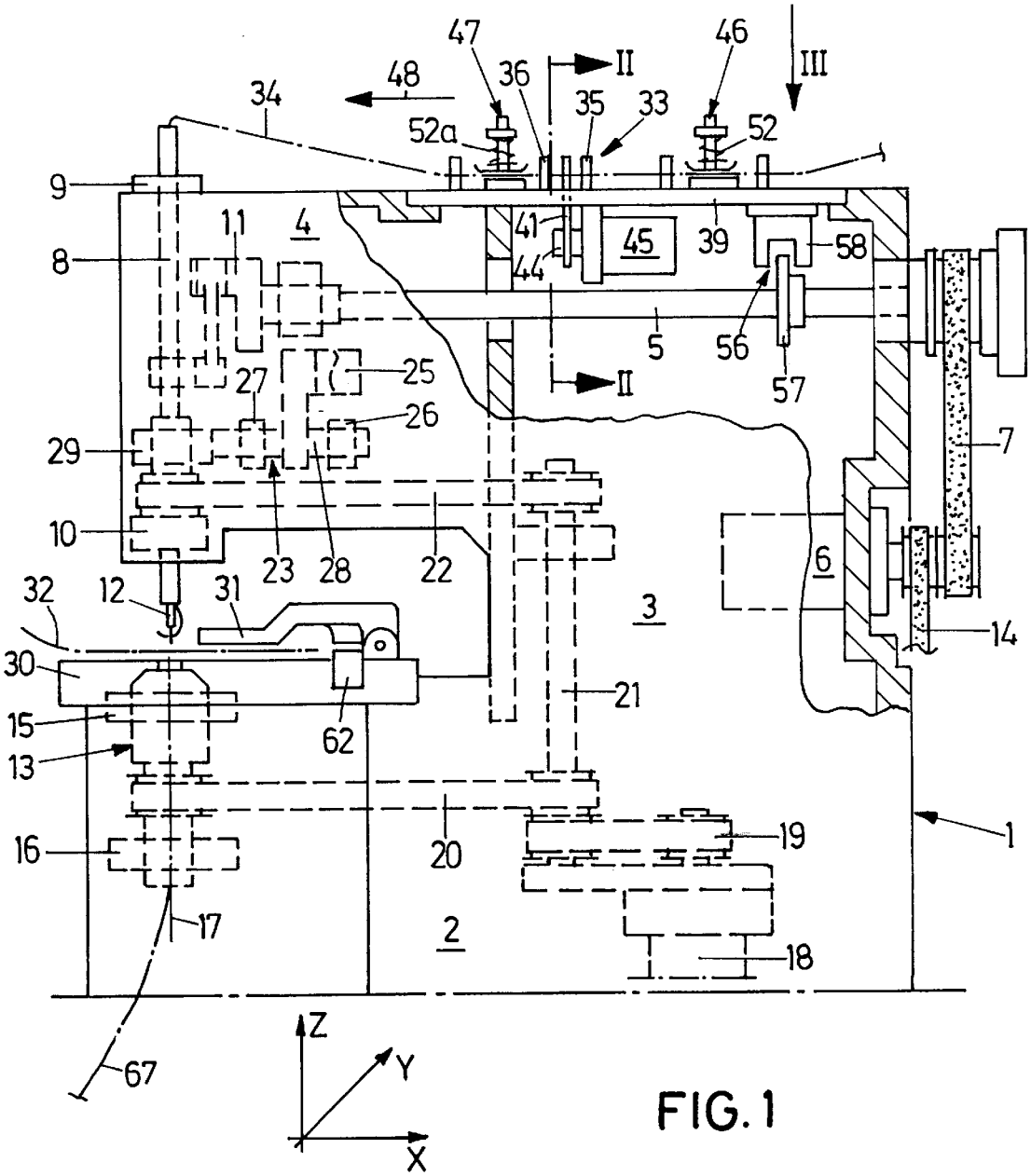
FIG. 1 is an illustration, partially broken away, of an elevation of a buttonhole sewing machine.
Figure 2:
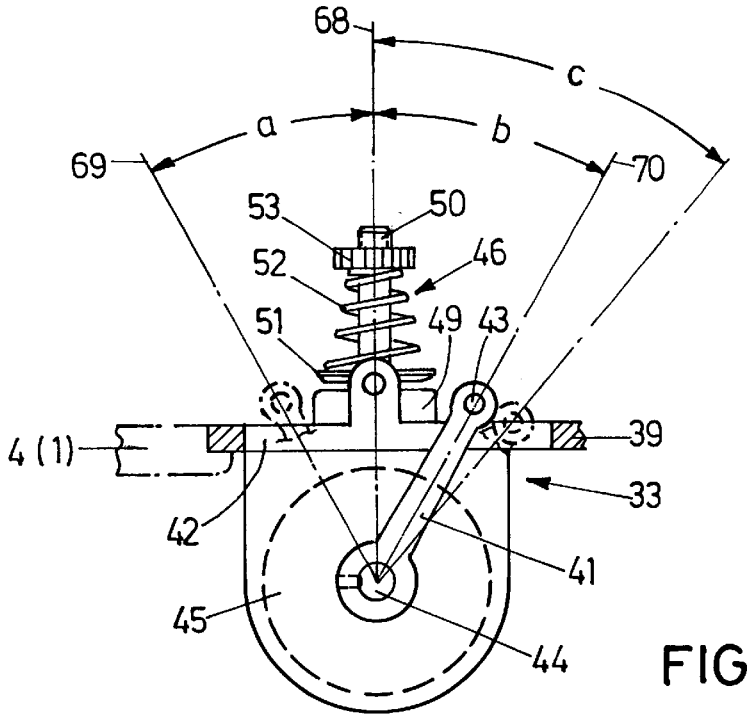
FIG. 2 is a view, on an enlarged scale, of a section, on the line II—II of FIG. 1, through a thread feeder disposed in the arm of the sewing machine.
Figure 3:
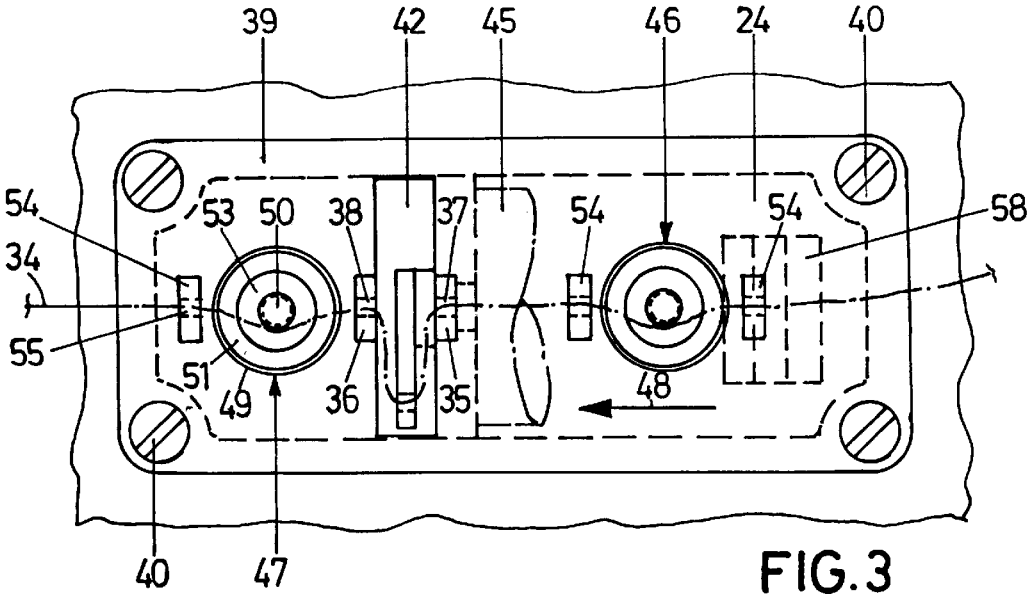
FIG. 3 is a plan view of the thread feeder along the arrow III of FIG. 1 on an enlarged scale.

The single/double thread chain stitch sewing machine seen in FIG. 1 comprises a housing 1, which substantially consists of a so-called base plate 2, a standard 3 and an upper arm 4. An arm shaft 5 is rotatably run in the arm 4 and can be driven in rotation by means of a driving motor 6 via a belt drive 7.

Mounted in the arm 4 in bearings 9, 10 is a substantially vertical and hollow needle bar 8, which can be driven to reciprocate by the arm shaft 5 via a crank drive 11. At its lower end, the needle bar 8 is provided with a needle 5.

Underneath the needle bar 8, a hook bearing 13, which comprises two commercial chain stitch hooks (only roughly outlined in FIG. 4) known for example from U.S. Pat. No. 1,372,473, is mounted in bearings 15, 16 for rotation by approximately 400° about a vertical pivot axis 17 which extends in the Z direction. Actuation of the hooks takes place via a driving connection 14 derived from the driving motor 6. Rotary actuation of the hook bearing 13 takes place via two belt drives 19, 20 by means of a stepper motor which serves as a pivot drive 18. The needle bar 8 is mounted in the bearings 9, 10 not only for displacement in the longitudinal direction, but also for rotation about a pivot axis 17. It is driven synchronously and equiangularly relative to the hook bearing 13 by the pivot drive 18 via a setting shaft 21, which is drivable by the belt drive 19 and extends in the Z direction, and by a further belt drive 22 so that the needle 12 and the hook bearing 13 are synchronously and equiangularly pivoted abut the pivot axis 17.

The needle bar 8 and the needle 12 are drivable to job laterally, i.e. to swing, by means of a needle jogging drive 23. The lateral jogging motion is accompanied with a deflection of the needle bar 8 relative to the pivot axis 17. Due to the rotatability of the needle bar 8, the jogging plane of the needle bar 8 with the needle 12 is displaceable synchronously and equiangularly relative to the position of rotation of the hook bearing 13. A stepper motor 25 is provided for the lateral jogging of the needle bar 8, this stepper motor 25 acting on the needle bar 8 by way of a jogging shaft 28. To this end, provision is made for a transmission 29 (not shown in detail), which is known from U.S. Pat. No. 1,991,627 and U.S. Pat. No. 6,095,066.

An X-Y table 30 (only roughly outlined) is disposed on the base plate 2. Design and actuation of the table 30 are also known from U.S. Pat. No. 6,095,066. A clamp 31 is mounted on the table 30, fixing a workpiece 32.

On the upper side of the arm 4, provision is made for a needle thread feeding mechanism denoted as a thread feeder 33 for a needle thread 34, which is fed to the needle 12 through the hollow needle bar 8 from the upper end thereof. The thread feeder 33 comprises two thread guide webs 35, 36, which are disposed at a distance from each other in the X direction and each of which has a hole 37, 38 in the vicinity of its upper side for the thread 34 to be threaded through. The holes 37, 38 are in alignment in the X direction. The two thread guide webs 35, 36 are mounted on a joint support plate 39 which is fixed to the upper side of the arm 4 by means of screws 40, closing a recess 24 in the arm 4. A thread level 41 is disposed between the two thread guide webs 35, 36. This thread lever 41 passes through an opening 42 in the support plate 39 of the thread feeder 33. On its end located above the support plate 39, the thread lever 41 has an eye 43, through which the needle thread 34 is threaded between the holes 37, 38. The thread level 41 is fastened on the shaft 44 of a stepper motor 45 which is mounted on the underside of the support plate 39.

Needle thread tighteners 46, 47 are provided on the path traveled by the needle thread 34 on both sides of the thread feeder 33 i.e., one after the other in the X direction, namely a first needle thread tightener 46 disposed upstream of the thread feeder 33 in the director of delivery 48, and a second needle thread tightening 47 disposed downstream of the thread feeder 33 in the direction of delivery 48. The two thread tighteners 46, 47 are structured identically with the exception of the conical coil springs 52, 52*a* inserted therein; therefore, only the thread tightener 46 is described. It comprises a bearing plate 49, which is mounted on the support plate 39 and serves as a first clamping jaw and from which a threaded bolt 50 projects upwards i.e., in the Z direction. Guided for displacement on the threaded bolt 50 is a clamping disk 51, which bears against the plate 49 and serves as a second clamping jaw and against which a prestressed conical coil spring 52 bears from above, it being possible to prestress the conical coil spring 52 by means of a clamping nut 53. Subject to friction that corresponds to the prestress of the second clamping jaw, the needle thread 34 travels between the clamping disk 51 and the plate 49. The conical coil spring 52 is such that the needle thread 34 tautened by a tension force of 1.6 N. By way of contrast, the conical coil spring 52*a* inserted in the tightener 47 is designed for the needle thread 34 to be tautened by a force of approximately 0.3 N. On both sides of the tightener 46, 47, needle thread guide webs 54 are provided, each having a hole 55, so that guidance of the needle thread 34 in the respective tightener 46 or 47 is ensured. On the side turned toward the thread feeder 33, this job can of course also be performed by the guide webs 35 or 36.

Provided in the arm 4 is a moment of momentum transmitter 56 as a position transmitter, comprising a slotted disk 57, which is mounted non-rotatably on the arm shaft 5, and a forked light barrier 58, which is mounted on the underside of the support plate 39, with the slotted disk 57 engaging with the formed light barrier 58. Moment of momentum transmitters 56 of this type are general practice and conventionally have a given number of slots, for instance 400, arranged at regular angular distances on the slotted disk so that, upon a rotation of the arm shaft 5, the moment of momentum transmitter 56 emits a number of signals equal to the number of slots in the slotted disk 57.

Figure 4:
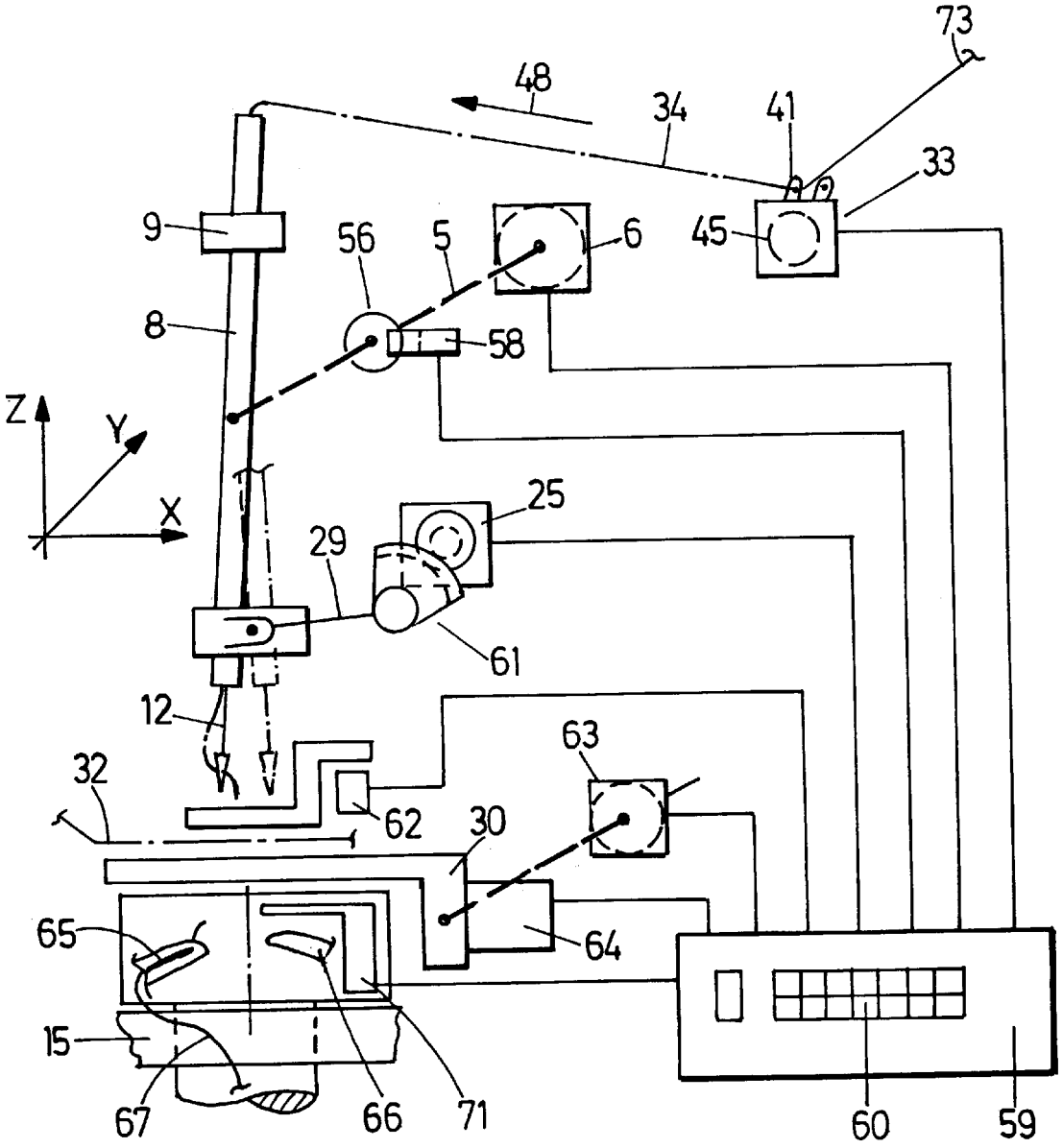
FIG. 4 is an illustration of operational diagram.

FIG. 4 illustrates the overall control principle. A central control unit 59 is provided, having an input equipment 60, for instance in the form of a keyboard. Via lines (seen in the drawing) this control unit 60 is connected to the stepper motor 45 of the thread feeder 33, to the driving motor 6, to the moment of momentum transmitter 56, to the stepper motor 25 of the needle zigzag drive 61, to the sensor of fabric thickness 62 disposed on the X-Y table 30, to a Y driving motor 63 of the X-Y table 30 and to an X driving motor 64 of the X-Y table 30. A thread cutter 71, which is triggerably by the control unit 59, is disposed in the hook bearing 13. FIG. 4 also roughly outlines a first hook 65 for a double thread chain stitch and a second hook 66 for a single thread chain stitch.

The sewing machine specified serves to sew buttonholes into the workpiece 32, for which two stitches are sewn crosswise of the lengthwise direction of the buttonhole seam at a distance from each other i.e., zigzagging; a first stitch of these two stitches is sewn as a single thread chain stitch, using the second hook 66, whereas the second stitch is sewn as a double thread chain stitch, using the first hook 65. The first stitch i.e., the single thread chain stitch, is made without the under-thread, whereas the second stitch, the double thread chain stitch, is made with a hook thread 67 being supplied. This is generally known practice. Since two different chain stitches are sewn alternately, also the needle thread 34 must alternately be supplied to the needle 12 or withdrawn. This takes place by means of the specified thread feeder 33.

Referred to its zero position 68 i.e., referred to a vertical position, the thread lever 41 is pivotal about a pivoting angle a in one direction or about a pivoting angle b in the other direction. The zero position 68 is defined such that, in this position, the needle bar 8 together with the needle 12 takes its elevated position i.e., its position in the upper dead center. The thread lever 41 pivots by the smaller pivoting angle a into a first position of thread extraction 69 when the needle 12, for sewing a single thread chain stitch, cooperates with the second hook 6 that has no thread. The thread lever 41 is pivoted by the greater pivoting angle b in the opposite direction into a second position of thread extraction 70 when the needle 12, for sewing a double thread chain stitch cooperates with the first hook 65 that leads the thread. To this end, the stepper motor 45, which triggers the thread lever 41, is triggered by the control unit 59 in dependence on the signals, emitted by the moment of momentum transmitter 56, of the angles of rotation of the arm shaft 5 and thus of the position of the needle 12. The measure of the respective pivoting angles a or b and thus the measure of the extracted needle thread 34 is fixable to correspond to details given by the operator in accordance with a certain sewing program. Automatic adaptation may also take place in dependence on the thickness of the workpiece 32 detected by the sensor of fabric thickness 62. Of course, the thread lever 41 will regularly pivot back into the zero position 68 when the needle thread 34 extracted during a pivoting motion into the position of thread extraction 69 or 70 is needed in the course of stitch formation. During the sewing job, a tension force of approximately 1.6 N+0.3 N=1.9 N is produced in the needle thread 34 by the action of the tighteners 46, 47. As a rule, the tension force the tightener 46 exercises on the needle thread 34 will exceed by three to ten times the tension force the tightener 47 exercises on the needle thread 34.

When the sewing job that serves for producing a buttonhole seam is finished, the needle 12 is stopped close to the upper dead center. While the needle 12 moves from the lower to the upper dead center, the thread level 41 is pivoted by a pivoting angle c into a position of thread extraction 72. The pivoting angle c is greater than the pivoting angle b. Upon this process of thread extraction, the quantity of needle thread 34 taken from the thread supply (not shown) is greater than the quantity that is extracted upon a pivoting motion by the angle b into the position of extraction 70. As the needle thread 34 is held in the vicinity of the stitch forming tools during this process of extraction, delivery from the thread supply 73 takes place although the tension force of the tightener 46, which works as a counterforce in this regard, is higher than that of the tightener 47. Once the quantity of thread has been extracted, the thread lever 41 is pivoted back into the zero position 68. The extracted thread is located in the area between the tighteners 46 and 47.

Then the thread cutter 71 is triggered by the control unit 59 and the needle thread 12 is cut. The tension force which, in this case, acts in the needle thread 34 is only approximately 0.3 N, because tension force is exercised on the needle thread 34 only by the tightener 47 neighboring the needle bar 8. When the needle thread 34 is cut through by the thread cutter 71, relief of the needle thread 34 takes place between the cut performed by the thread cutter 71 and the tightener 47 and that by the tension force of approximately 0.3 N exercised by the tightener 47. Consequently, there is no unthreading the needle thread 34 from the needle 12.

When a new buttonhole sewing job is started, sufficient needle thread 34 for the initial stitching jobs is available between the tighteners 46, 47. The quantity of thread available after the thread cutting job corresponds to the one that has been pulled off in the position of thread extraction 70 by the thread lever 41. Of course, also the size of the pivoting angle c can be set in the control unit 59.

What is claimed is:

1. A buttonhole sewing machine for the production of buttonholes on a workpiece (32) of fabric, comprising a needle (12) mounted in an arm (4), which needle (12) is reciprocatingly drivable in a Z direction by a driving motor (6), forming a series of stitches, which needle (12) is drivable by a jogging drive (23) for the production of a zigzag seam by a motion of the needle (12) relative to the workpiece (32), and which needle (12) is drivable to pivot about an axis by means of a pivot drive (18);

a hook bearing (13), which is disposed in a base plate (2), and which is drivable by a pivot drive (18) to pivot synchronously and equiangularly relative to the needle (12) about a pivot axis (17) which extends in the Z direction; and a thread feeding mechanism (33) in the path of a needle thread (34) which is fed in a direction of delivery (48);

wherein the thread feeding mechanism (33) comprises a pivotal thread lever (41) with an opening (42) for the needle thread (34) to be led through; and wherein the thread lever (41) is drivable by a triggerable positioning motor (45) to pivot between a zero position (68) and several positions of thread delivery (69, 70, 72).

2. A buttonhole sewing machine according to claim 1, wherein the positioning motor is a stepper motor (45).

3. A buttonhole sewing machine according to claim 1, wherein a control unit (59) is provided, which is connected to the positioning motor (45) and, for triggering the positioning motor (45), to a position transmitter (56) which detects the position of the needle (12).

4. A buttonhole sewing machine according to claim 3, wherein the control unit (59) is connected to a sensor (62) detecting the thickness of the fabric for control of the positioning motor (45) in dependence on the thickness of the fabric of the workpiece (32).

5. A buttonhole sewing machine according to claim 1, wherein, in the direction of delivery (48) of the needle thread (34), a first needle thread tightener (46) is disposed upstream of the thread feeding mechanism (33) and a second needle thread tightener (47) is disposed downstream of the thread feeding mechanism (33).

6. A buttonhole sewing machine according to claim 5, wherein the first needle thread tightener (46) is designed for exercising on the needle thread (34) a greater tension force that does the second needle thread tightener (47).

7. A buttonhole sewing machine according to claim 6, wherein the first needle thread tightener (46) is designed for the tension force it exercises on the needle thread (34) to exceed by three to ten times the tension force exercised by the second needle thread tightener (47).

8. A buttonhole sewing machine according to claim 7, wherein a thread cutter (71) is allocated to the hook bearing (13); and wherein the thread level (41) is drivable to pivot about first, second and third pivoting angles a, b, c into positions of thread extraction (69, 70, 72), with a position of thread extraction (72) being provided for a thread cutting job and with the third pivoting angle c allocated to this position for a thread extraction (72) being greater than the first and second pivoting angles a, b.

9. A buttonhole sewing machine according to claim 5, wherein the needle thread tighteners (46,47) comprise first and second clamping jaws (49, 51) which guide the needle thread (34) between them and are forced towards one another by a prestressed spring **(52, 52*a*)**.

10. A buttonhole sewing machine according to claim 9, wherein the spring **(50, 52*a*) is prestressed by an adjusting device (53)**.

* * * * *